US008151483B2

(12) United States Patent
Cooper et al.

(10) Patent No.: US 8,151,483 B2
(45) Date of Patent: Apr. 10, 2012

(54) PROGRESSIVE DEWATERING AND INHIBITOR DISPERSAL ROLLING PIG

(75) Inventors: Charles Culver Gidden Cooper, Arvada, CO (US); Mark Russell Henault, Westminster, CO (US); Robert F. Strong, Collinsville, OK (US); Eric N. Freeman, Kiefer, OK (US)

(73) Assignee: TDW Delaware, Inc., Wilmington, DE (US)

( * ) Notice: Subject to any disclaimer, the term of this patent is extended or adjusted under 35 U.S.C. 154(b) by 161 days.

(21) Appl. No.: 12/830,939

(22) Filed: Jul. 6, 2010

(65) Prior Publication Data

US 2012/0006420 A1 Jan. 12, 2012

(51) Int. Cl.
*F26B 3/00* (2006.01)

(52) U.S. Cl. ..... 34/513; 34/437; 34/467; 166/423; 166/383; 138/89; 134/8

(58) Field of Classification Search ..... 34/513, 34/526, 437, 467, 138, 210, 217, 90; 166/423, 166/383; 138/89; 134/8
See application file for complete search history.

(56) References Cited

U.S. PATENT DOCUMENTS

| | | | | |
|---|---|---|---|---|
| 3,788,084 | A * | 1/1974 | Matthews, Jr. | 405/173 |
| 3,857,132 | A * | 12/1974 | Knapp et al. | 15/104.061 |
| 4,411,039 | A | 10/1983 | Timmins et al. | |
| 4,422,477 | A * | 12/1983 | Wittman et al. | 138/89 |
| 4,434,427 | A * | 2/1984 | Clarke et al. | 346/33 P |
| 4,494,584 | A * | 1/1985 | Rognoni | 141/98 |
| 4,498,932 | A * | 2/1985 | Kruka | 134/8 |
| 4,708,202 | A * | 11/1987 | Sukup et al. | 166/123 |
| 4,875,615 | A * | 10/1989 | Savard | 228/119 |
| 4,903,414 | A * | 2/1990 | White et al. | 34/415 |
| 5,186,757 | A * | 2/1993 | Abney, Sr. | 134/8 |
| 5,232,475 | A | 8/1993 | Jepson | |
| 5,293,905 | A * | 3/1994 | Friedrich | 138/89 |
| 5,544,672 | A | 8/1996 | Payne et al. | |
| 5,565,633 | A * | 10/1996 | Wernicke | 73/865.8 |
| 5,778,934 | A * | 7/1998 | Campbell | 138/89 |
| 5,997,608 | A * | 12/1999 | Diehl et al. | 75/446 |
| 6,129,118 | A * | 10/2000 | Friedrich et al. | 138/89 |
| 6,263,534 | B1 | 7/2001 | McCann et al. | |
| 6,561,280 | B1 * | 5/2003 | Baugh et al. | 166/383 |
| 6,596,089 | B2 * | 7/2003 | Smith et al. | 134/8 |

(Continued)

FOREIGN PATENT DOCUMENTS

CH 664306 A * 2/1988

(Continued)

*Primary Examiner* — Stephen M. Gravini
(74) *Attorney, Agent, or Firm* — Gable Gotwals

(57) ABSTRACT

A method for progressively dewatering a pipe or pipeline includes the use of a loose-fitting spherical- or quasi-spherical shaped pig body which rolls forward through the interior space of the pipe and temporarily captures and redistributes a portion of the volume of liquids available for capture and redistribution as the pig body rolls on past. Preferably, the portion captured is less than the volume available for capture. A part of the captured liquid may be redistributed to an upper quadrant of the pipe. Capture and redistribution are accomplished by way of a first bypass pathway and a second bypass pathway. One of the pathways may be a through-body pathway. The pig body may be a hollow pig body with a plurality of spaced-apart ports, a solid pig body with a plurality of paddle-like structures, or a cube-sphere type pig body with recessed external wall surfaces.

21 Claims, 6 Drawing Sheets

U.S. PATENT DOCUMENTS

| | | | | |
|---|---|---|---|---|
| 7,222,542 | B2 | 5/2007 | Eken et al. | |
| 7,395,864 | B2 | 7/2008 | Ramachandran et al. | |
| 7,611,635 | B2 | 11/2009 | Chieng et al. | |
| 7,766,046 | B2 * | 8/2010 | Syse et al. | 138/89 |
| 8,025,738 | B2 * | 9/2011 | Munden | 134/8 |
| 8,042,574 | B2 * | 10/2011 | Mellemstrand et al. | 138/89 |
| 2006/0112588 | A1 * | 6/2006 | Ness et al. | 34/513 |
| 2007/0003371 | A1 | 1/2007 | Yemington | |
| 2008/0196268 | A1 * | 8/2008 | Jung et al. | 34/603 |
| 2009/0301729 | A1 | 12/2009 | Makogon et al. | |
| 2010/0011875 | A1 | 1/2010 | Vyas et al. | |
| 2010/0011876 | A1 | 1/2010 | Vyas et al. | |
| 2011/0041357 | A1 * | 2/2011 | Docters Van Leeuwen | 34/467 |
| 2011/0214309 | A1 * | 9/2011 | Ness et al. | 34/526 |
| 2012/0006420 | A1 * | 1/2012 | Cooper et al. | 137/15.07 |

FOREIGN PATENT DOCUMENTS

| | | | | |
|---|---|---|---|---|
| CH | 664306 | A5 | * | 2/1988 |
| DE | 4104507 | A1 | * | 10/1992 |
| GB | 2208311 | A | * | 3/1989 |
| JP | 61107112 | A | * | 5/1986 |
| JP | 62083608 | A | * | 4/1987 |
| JP | 2007036503 | A | * | 2/2007 |

* cited by examiner

PROGRESSIVE DEWATERING AND INHIBITOR DISPERSAL ROLLING PIG

BACKGROUND OF THE INVENTION

This invention relates generally to pipeline pigs which travel through an interior of a pipeline and service and maintain the pipeline. More particularly, the invention relates to pigs used to dewater a multi-phase or predominantly gas pipeline in which liquids are present and disperse inhibitor within the line.

In multi-phase gas production pipelines, or similar systems in which liquids are present in a predominantly gas pipeline, a need often exists to push out only a small portion of the liquids in order to prevent overrunning limited capacity processing equipment or slug-catchers. For example, in high liquid-hold-up pipelines with slug-catching or process overrun limitations—or in applications in which top of the line corrosion requires inhibitor treatment—moving conventional pigs and/or spray pigs through the line causes process upsets or slug-catcher overrun because these pigging solutions (for liquid removal or inhibitor application) push most or substantially all the liquid out of the pipeline in a single pass. In many cases, use of these pigs involves complete shutdown, partial shutdown or other more costly operating scenarios.

The invention disclosed herein provides an operating scenario solution in lieu of conventional pigs or expensive pipeline system re-design—such as installing larger slug-catchers, using smaller diameter pipeline to achieve an annular versus stratified flow regime, or deploying expensive processing equipment—while avoiding process upset costs and maintaining normal production rates and revenue streams.

SUMMARY OF THE INVENTION

A method for progressively dewatering a pipe or pipeline includes the use of a loose-fitting spherical- or quasi-spherical shaped pig body which rolls forward through the interior space of the pipe and temporarily captures and redistributes a portion of the volume of liquids available for capture and redistribution as the pig body rolls on past. Preferably, the portion captured is less than the volume available for capture. A part of the captured liquid may be redistributed to an upper quadrant of the pipe.

Capture and redistribution are accomplished by way of a first bypass pathway and a second bypass pathway. The first and second bypass pathways allow gas flow to bypass the pig body at a velocity greater than a velocity of the pig body as the pig body rolls forward. The amount of bypass provided by the first bypass pathway may be different than the amount of bypass provided by the second bypass pathway.

In one preferred embodiment of the pig body, the first bypass pathway is a through-body pathway and the second bypass pathway is an external bypass pathway. The through-body pathway may be coaxial to a central axis of the pig body. Further, the pig body may be a hollow body with the through-body pathway being provided by a plurality of spaced apart ports arranged about the pig body. The hollow body may include a plurality or ribs on the internal wall surface or, preferably, a reinforcing layer disposed between the internal and external wall surfaces to provide stiffness reinforcement.

In another preferred embodiment, the first and second bypass pathways are external bypass pathways and one or more of the pathways may be formed in part by a textured external wall surface. Further, the first or second bypass pathway (or both) may be a radially extending paddle-like structure. The paddles may be arcuate-shaped surfaces that share a common edge and are arranged substantially orthogonal one another. The arcuate-shaped surfaces may include a lip located along a circumferential edge.

In yet another preferred embodiment, the first or second bypass pathway (or both) is formed by at least two arcuate-shaped oblique-angled surfaces that share a common edge. The oblique-angled surfaces may include a lip located along a circumferential edge. In still yet another preferred embodiment, the second bypass pathway is formed in part by a polygonal-shaped recessed portion of the external wall surface, with the first bypass pathway being formed by a convex curved external wall surface.

An object of this invention is to provide a rolling pig that may be used pushing out only a small portion of the liquids present in a multi-phase or predominantly gas pipeline in order to prevent overrunning limited capacity processing equipment or slug-catchers. Another object of this invention is to provide a rolling pig that may be de-optimized for progressive and sequential dewatering of a multi-phase or predominantly gas pipeline in which liquids are present. Yet another object of this invention is to provide a rolling pig for dispersing inhibitor within the line. Still yet another object of this invention is to provide a rolling pig that provides an operating scenario solution in lieu of conventional pigs or expensive pipeline system re-design—such as installing larger slug-catchers, using smaller diameter pipeline to achieve an annular versus stratified flow regime, or deploying expensive processing equipment—while avoiding process upset costs and maintaining normal production rates and revenue streams.

DETAILED DESCRIPTION OF THE PREFERRED EMBODIMENTS

Figure 1:
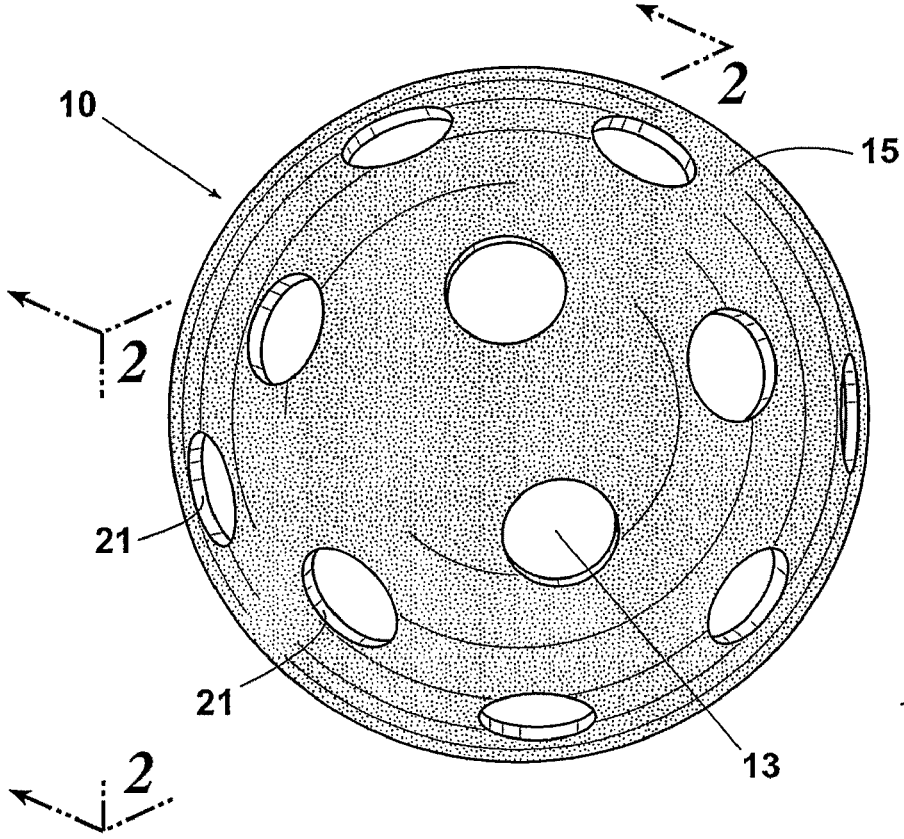
FIG. 1 is a view of a preferred embodiment of a spherical-shaped rolling pig made and used according to this invention. The loose fitting, perforated sphere pig includes through-body and external bypass pathways to ensure rolling or tumbling forward for the purpose of capturing, carrying, redistributing liquids residing at various depths within an interior space of a multi-phase or predominantly gas pipeline.
Figure 2:
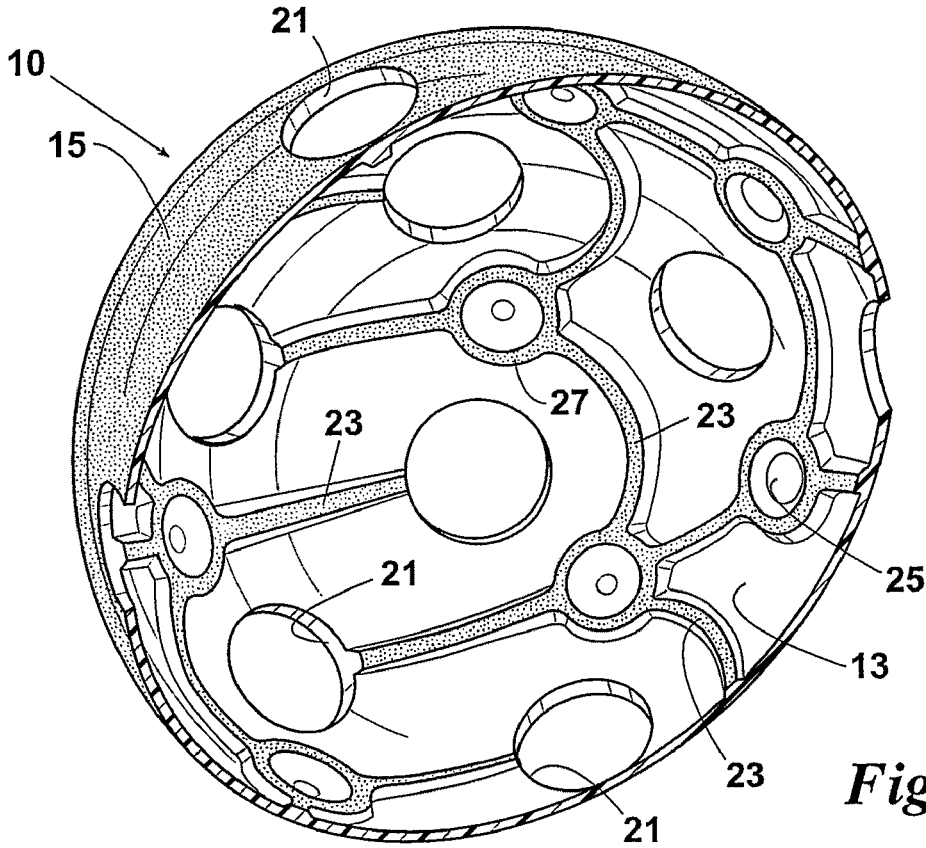
FIG. 2 is section view of the rolling pig of FIG. 1. In this embodiment, ribbed surfaces located on the interior surface of the pig primarily provide stiffness reinforcement and help capture, carry and redistribute liquids that enter (and then exit) through one or more access ports (see FIG. 4). An alternative to the ribbed reinforcement is wire mesh embedded in the elastomeric material (see FIG. 12).
Figure 3:
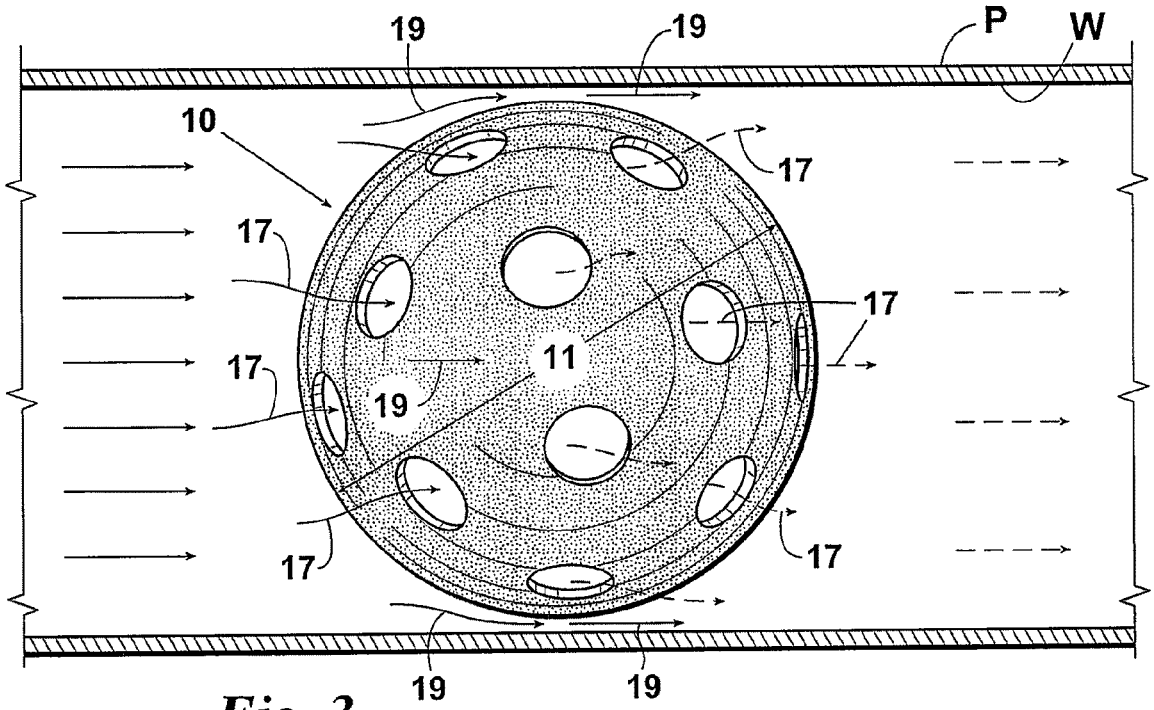
FIG. 3 is a view of the rolling pig of FIG. 1 as it rolls or tumbles forward in the direction of product flow through an interior of a pipe. Rather than pushing forward all or substantially all of the liquids it encounters, the pig preferably captures, carries and redistributes to the top of the pipe only a portion of the volume of liquids available for capture as the pig rolls past that volume of liquids.
Figure 4:
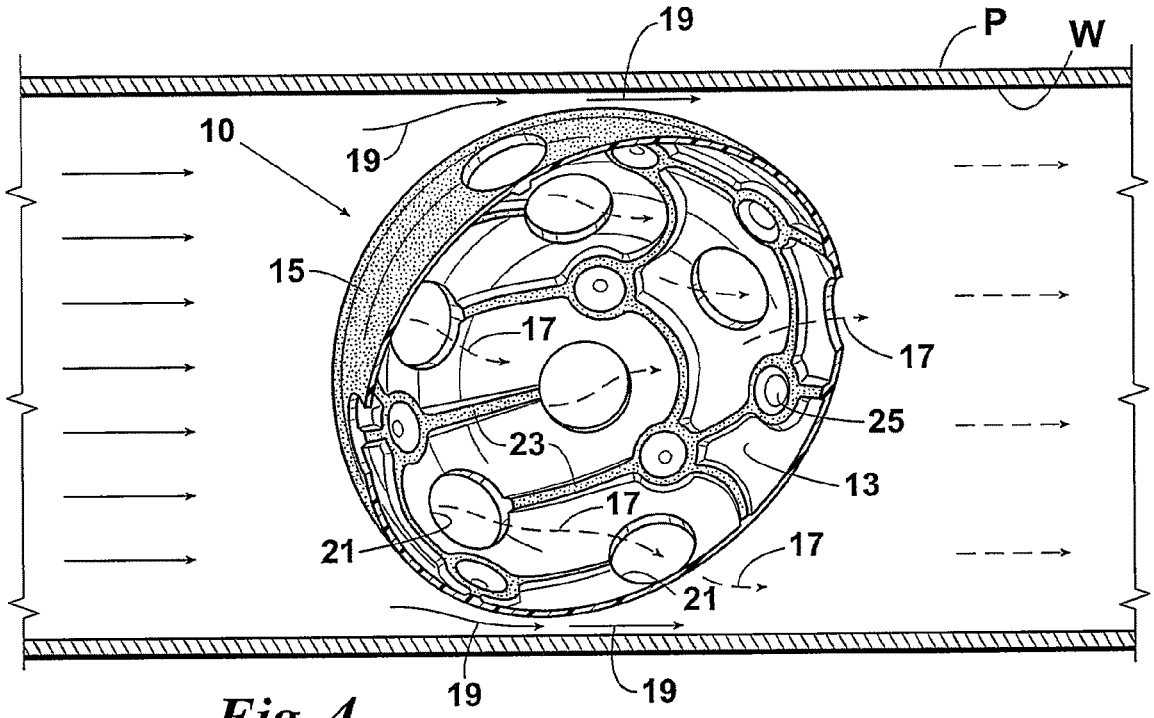
FIG. 4 is a cross-section view of the rolling pig of FIG. 1 as it rolls or tumbles forward in the direction of product flow.

Preferred embodiments of a rolling pig made and used according to this invention are described below with reference to the drawings and the following elements illustrated in the drawings:

| | | | |
|---|---|---|---|
| 10 | Spherical-shaped rolling pig | 29 | Wire mesh |
| 11 | Diameter of 10 | 31 | Central axis of 10 |
| 13 | Internal surface | 33 | Outer circumferential edge |
| 15 | External surface | 37 | Lip |
| 17 | Through-body bypass pathway | 53 | External surface |
| 19 | External bypass pathway | 73 | External surface |
| 21 | Port | 93 | External surface |
| 23 | Rib | 95 | External surface |
| 25 | Dimple | 103 | External surface |
| 27 | Bump | 105 | External surface |

Referring to the drawings and first to FIGS. 1-4, a rolling pig 10 having a perforated sphere or WIFFLE® ball-like external appearance is launched into an interior space of a multi-phase or predominantly gas pipeline (or piping system) P and allowed to roll or tumble forward in a non-linear fashion through the interior of the pipe P. As pig 10 rolls forward, it temporarily captures, carries, and redistributes bottom-of-pipe liquids residing at various depths in the pipe P.

Preferably, not all of the liquids encountered at the various depths are pushed forward by pig 10. Rather, pig 10 (in this and all of the embodiments disclosed herein) is designed to limit the forward pushing of these liquids so as to not cause process upsets or slug catcher overruns. Therefore, pig 10 is preferably a loose-fitting pig, having a diameter 11 in a range of about 90% to 95% of the diameter D of pipe P. This loose-fit allows pig 10 to travel in a non-linear motion at times as it rolls or tumbles forward through the interior of pipe P and limits the amount of liquids pushed forward.

Pig 10 may be further "de-optimized" for liquid removal for the purpose of "progressively de-watering" a pipeline P over the course of multiple runs of the pig 10. For example, each embodiment illustrated herein may be designed to capture less water, so that a series of pig 10 with the same configuration but slightly different dimensional characteristics can be employed to progressively remove the water level in the pipeline to some minimum level allowed for by slug catchers or other facility limitations. Alternatively, different configurations of pig 10 may be used alone or in series to accomplish a desired progressive dewatering or inhibitor dispersal. In tests conducted by the inventors, the shapes of the perforated sphere embodiment (FIG. 1) and the offset paddle embodiment (FIG. 5) were optimized to lift a portion of the bottom-running liquids to the top of the pipe for the purpose of applying corrosion inhibitor-containing liquid.

The perforated sphere pig 10 uses a combination of through-body and external bypass pathways to ensure rolling as opposed to a sliding motion and limit forward pushing of bottom-of-pipe liquids located at various depths within the interior of pipe P. Through-body bypass pathways 17—which are required on the perforated sphere embodiment but not required on all embodiments—are provided by a plurality of spaced-apart ports 21 located about the external surface 13 of pig 10. External bypass pathways 19 are provided between the spherical-shaped external wall surface 13 and the inner wall W of pipe P. As pig 10 encounters a section of pipe P containing liquids, a portion of the liquids enters one or more of the ports 21 and is captured and carried or lifted temporarily within the interior space of pig 10. Some or all of the liquids may also breakup and disperse upon encountering pig 10. As pig 10 continues to roll or tumble forward, a portion of the captured liquids exits one or more of the ports 21 and is redistributed fore or aft (or above or below) the pig 10. In scale-model tests of the perforated sphere embodiment of pig 10, liquid retention performance proved adequate but redistribution performance to the top of the pipe improved as pipeline flow speeds (rolling rpm) increased.

Figure 12:
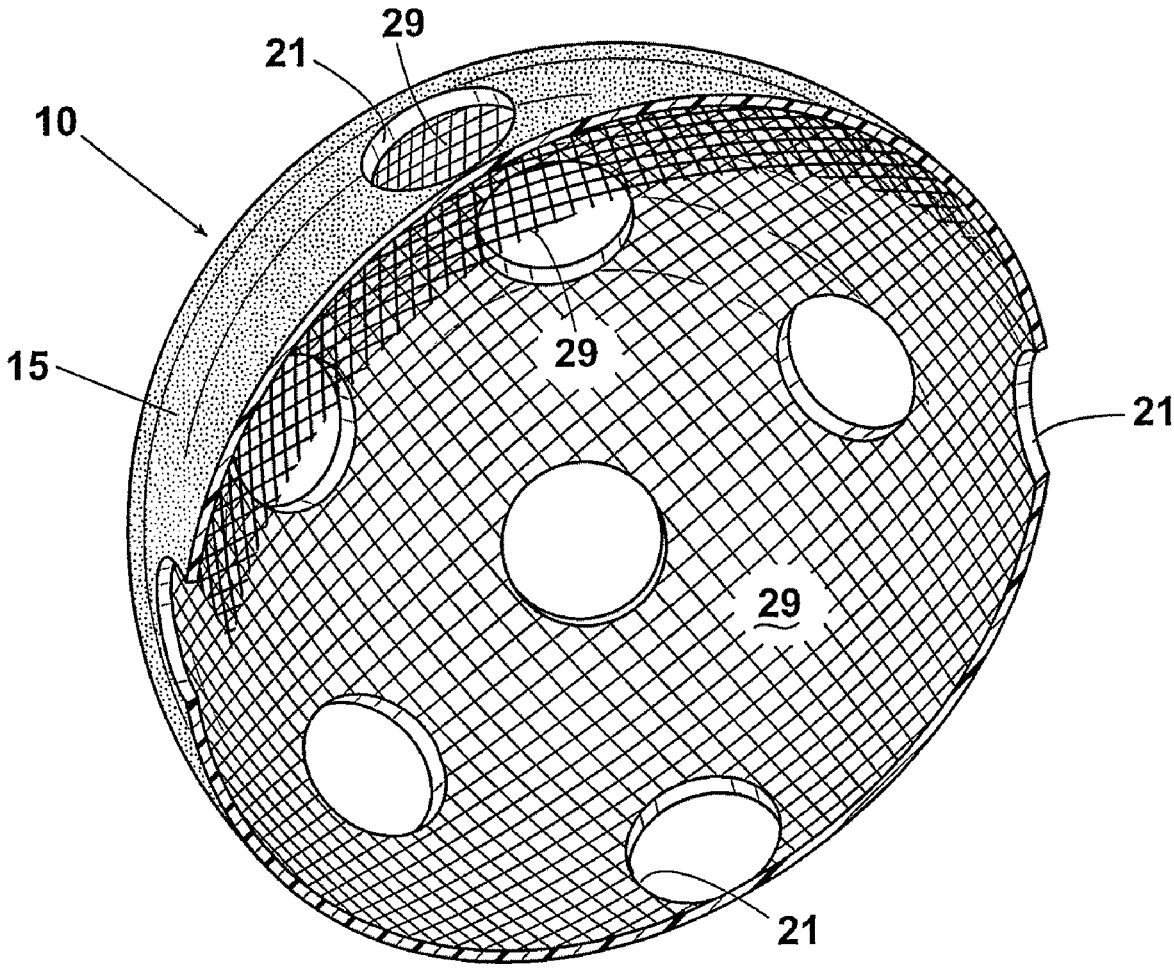
FIG. 12 is an alternate and preferred embodiment of the perforated sphere-type rolling pig. The wire mesh provides the needed stiffness reinforcement. The relatively thin wall to diameter ratio allows for even shallow water hold-up in the bottom of the pipe to enter the bottom of the sphere and be lifted during the rolling action.

To provide stiffness and reinforcement of pig 10, and to a lesser degree to assist with the carrying and redistributing of captured liquids, the structure of the internal wall surface 15 of pig 10 may include a plurality of arcuate-shaped ribs 23, along with dimples 25 and bumps 27, which give the internal wall surface 15 a soccer ball-like appearance. An alternative, and preferred, embodiment uses a wire mesh 29 impregnated with the elastomeric material of pig 10 to provide the stiffness and reinforcement (see FIG. 12). The relatively thin wall to diameter ratio allows for even shallow water hold-up in the bottom of the pipe to enter the bottom of the sphere and be lifted during the rolling action.

Figure 5:
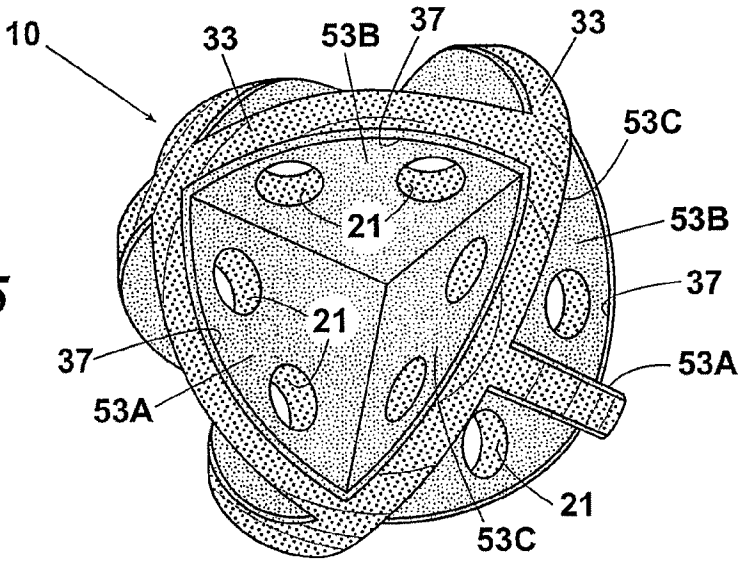
FIG. 5 is a view of another preferred embodiment of a spherical-shaped rolling pig made and used according to this invention. The loose-fitting, offset paddle pig has paddle surfaces arranged orthogonal to each other and with each paddle in the upper half of the pig offset about 90° from a complementary paddle surface located in the lower half of the pig. Each paddle may include one or more through-body pathways to slow velocity (and therefore reduce the amount of de-watering). An external lip may be provided along the circumferential edge of each paddle to improve rolling and redistribution performance or wetting enhancement.
Figure 6:
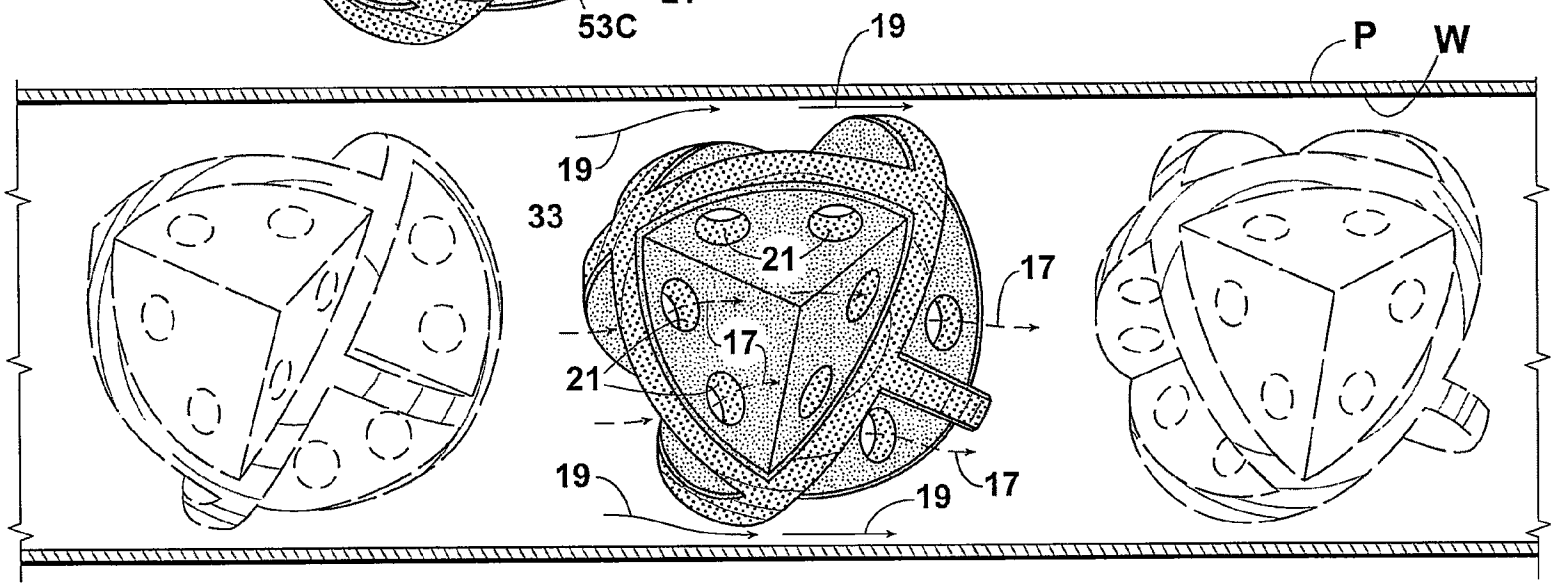
FIG. 6 is a view of the rolling pig of FIG. 5 as it rolls or tumbles forward in the direction of product flow through an interior of a pipe. The paddle surfaces provide external bypass pathways.

Turning now to FIGS. 5 & 6, another preferred embodiment of rolling pig 10 employs a paddle or paddle-sphere configuration in which circular-sector shaped external wall surfaces 53A-C are arranged adjacent and substantially orthogonal to one another. Further, the set of external wall surfaces 53A-C located in the upper half of pig 10 are preferably offset about 90° from a corresponding set of respective opposing external wall surfaces 53A-C in the lower half of pig 10. In scale-model tests, the redistribution performance of this particular embodiment of pig 10 was not significantly affected as pipeline flow speed varied.

To further improve rolling and liquid redistribution performance, a lip 37 may be provided along the circumferential edge 33 of one or more of the external wall surfaces 53. To provide additional bypass and slow rolling speed (and therefore de-optimize dewatering), each external wall surface 53 may also include one or more spaced-apart ports which provide a through-body pathway 17.

The external wall surfaces 53 in this embodiment of pig 10 combine with the inner wall W of the pipe P to provide somewhat variable external bypass pathways 19. Each set of external wall surfaces 53A-C combine to form an area or quadrant in the upper or lower half of pig 10 that captures, carries and redistributes a portion of the liquid encountered by pig 10 as pig 10 rolls or tumbles forward through the interior of the pipe.

Figure 7:
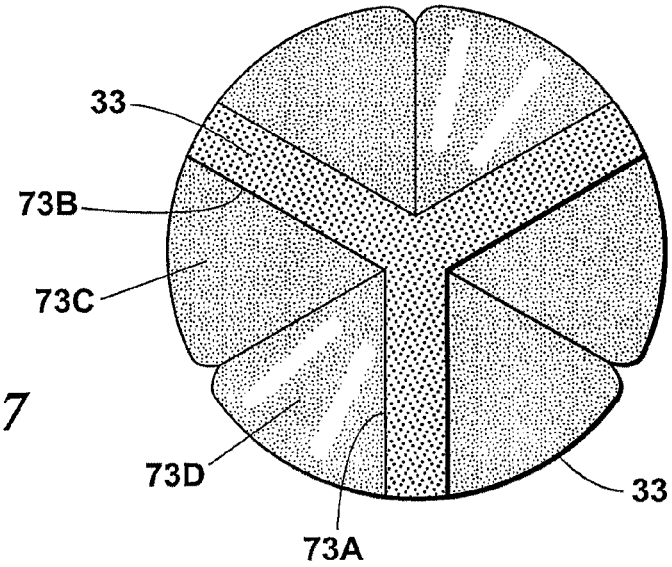
FIG. 7 is a view of yet another preferred embodiment of a spherical-shaped rolling pig made and used according to this invention. The loose-fitting pig has a paddle configuration with v-shaped paddle surfaces arranged at about 120° to one another. Each paddle may be textured to help redistribute liquids captured between adjacent surfaces. Although not necessary, a lip may be added along the circumferential edge of the paddle surfaces and through holes may be added to improve function or slow velocity.

Referring to FIG. 7, another paddle-sphere embodiment of pig 10 is illustrated. Similar to the orthogonal and offset paddle relationships of FIGS. 5 & 6, the external wall surfaces 73A-D are circular-sector shaped surfaces which form an external bypass pathway (not shown) between the wall surfaces 73 and the inner wall W of the pipe P. However, unlike the paddle surfaces 53 of FIGS. 5 & 6, the external wall surfaces 73A-D in this embodiment are arranged oblique relative to one another and the surfaces 73A-D in the upper half of pig 10 are not offset relative to those in the lower half.

Each set of adjacent surfaces 73A-D form an area in the upper or lower half of the pig body 10 that captures, carries and redistributes a portion of the liquid encountered by pig 10 as pig 10 rolls or tumbles forward through the interior of the pipe P. Further, the surfaces 73 may be textured to provide improved liquid capture and redistribution performance. A lip 37 may also be provided along the circumferential edge 33 of one or more the external wall surfaces 73. One or more through-body pathways 17 may be used to provide additional bypass to slow rolling speed and de-optimize dewatering.

Figure 8:
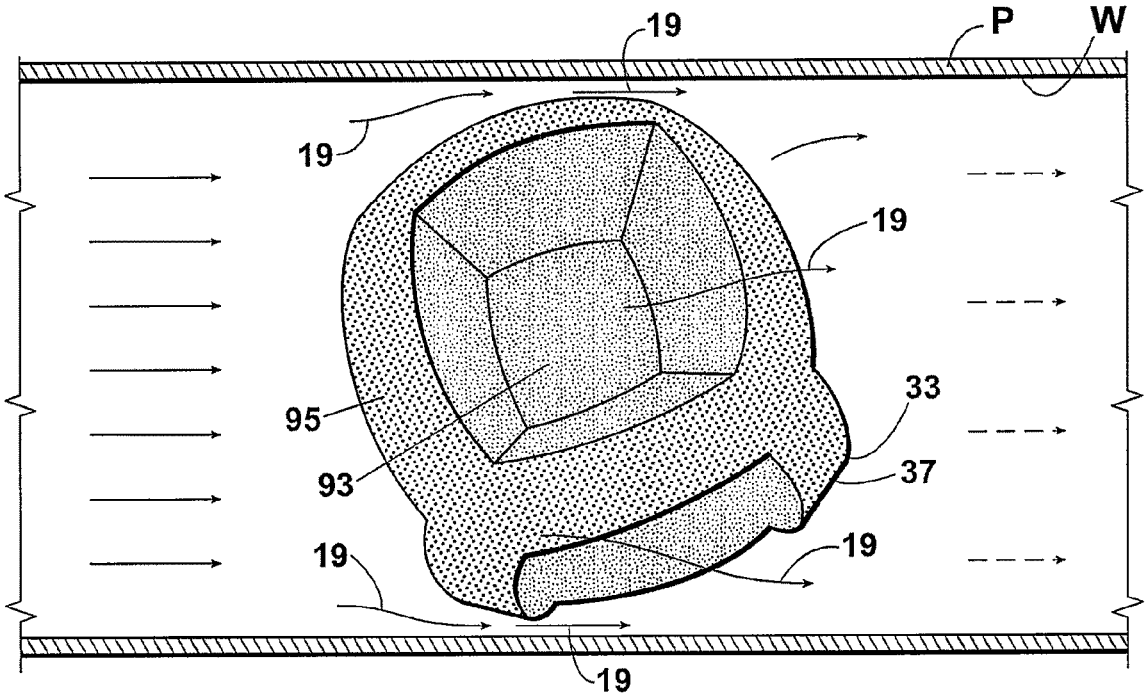
FIG. 8 is a view of another preferred embodiment of a spherical-shaped rolling pig made and used according to this invention. The loose-fitting, cube-sphere pig is a combination of convex surfaces and recessed, polygonal-shaped surfaces. The polygonal-shaped surface, which is preferably cube-shaped, helps capture, carry, and redistribute a portion of the liquids encountered as the pig rolls or tumbles forward.

Turning now to FIG. 8, a still yet another embodiment of pig 10 is quasi-spherical in shape with a convex external wall surface 95 and a recessed polygonal-shaped external wall surface 93. External wall surface 93 is preferably cubed-shaped and slightly curved. To improve rolling and liquid redistribution performance, a lip 37 may be provided along a circumferential edge 33 of external wall surface 95. External wall surface 93 captures, carries, and redistributes a portion of the liquid encountered by pig 10 as pig 10 rolls or tumbles forward through the interior of the pipe P. One or more through-body pathways 17 may be provided. In scale-model testing, this particular embodiment of pig 10 provided minimal to moderate redistribution at all but the slowest tested speed.

Figure 9:
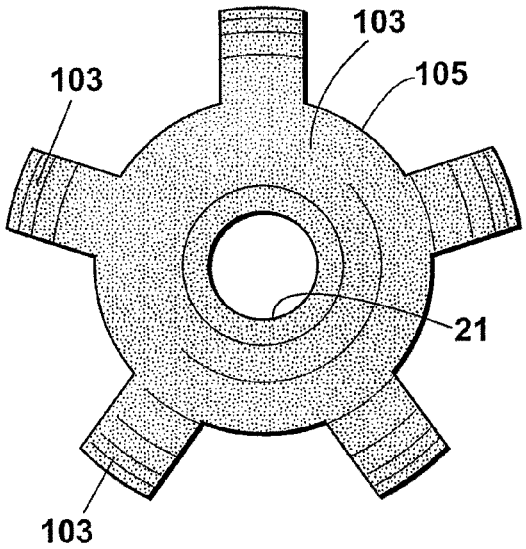
FIG. 9 is a view of still yet another preferred embodiment of a spherical-shaped rolling pig made and used according to this invention. The loose-fitting, paddle type pig has a centrally located through-body bypass pathway surrounded by paddle surfaces.
Figure 10:
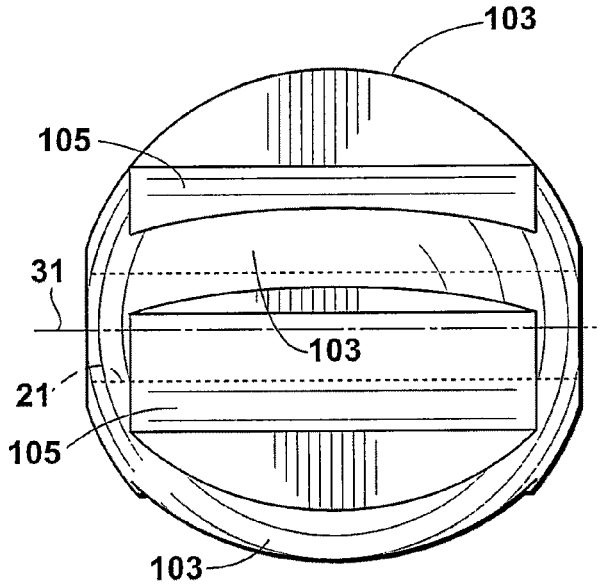
FIG. 10 is a side view of the rolling pig of FIG. 9.
Figure 11:
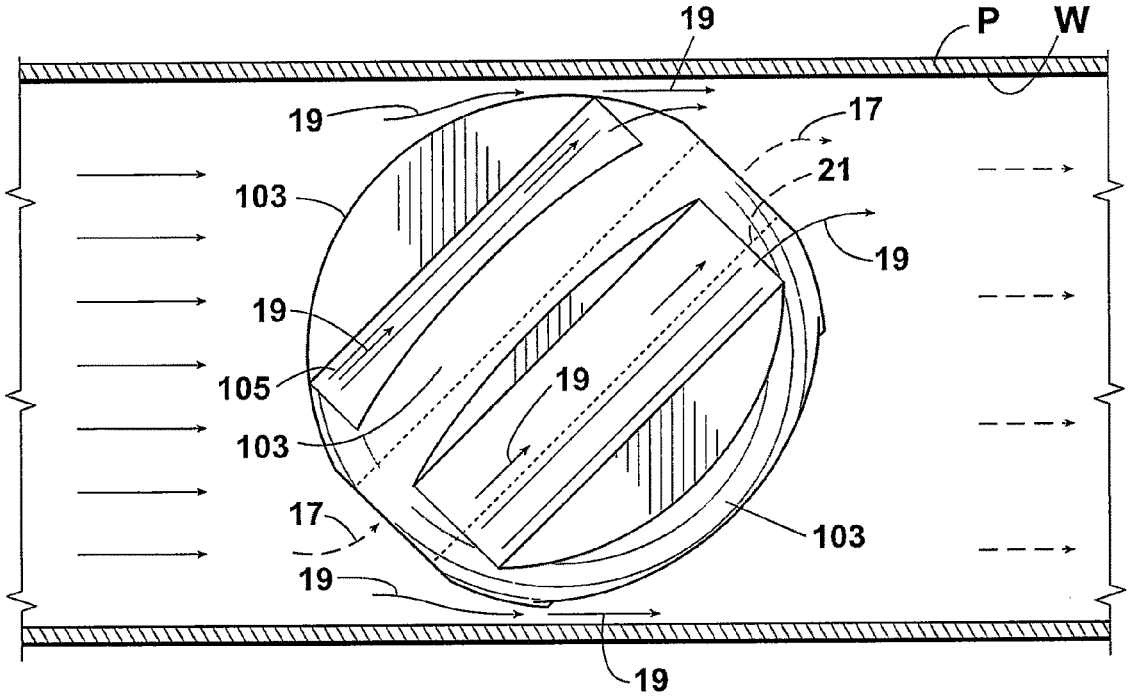
FIG. 11 is a view of the rolling pig of FIG. 9 as it rolls or tumbles forward in the direction of product flow through an interior of a pipe. The ends and face surfaces of the paddles as well as the curved surface between adjacent paddles provide external bypass pathways between the pig and the pipe wall.

Last, referring to FIGS. 9-11, another paddle-sphere embodiment of pig 10 includes a plurality of external wall surfaces or ribs 103 extending radially outward from a spherical-shaped external wall surface 105. The wall surfaces 103, 105 combine with one another and the inner W of pipe P to provide external bypass pathways 19. A port 21 located along a central axis 31 of pig 10 provides a through-body bypass pathway 17.

While a spherical-shaped or quasi-spherical shaped rolling pig and method for its use has been described with a certain degree of particularity, many changes can be made in the details of construction and the arrangement of components and steps without departing from the spirit and scope of this disclosure. Therefore, a rolling pig made according to this disclosure is not limited to the preferred embodiments described, but is limited only by the scope of the attached claims, including the full range of equivalency to which each element thereof is entitled.

What is claimed is:

1. A method for progressively dewatering a pipe or pipeline, the method comprising the steps:

launching a pig body into an interior space of a pipe having a gas product flow under pressure, the pig body being selected from the group consisting of a spherical-shaped pig body and a quasi-spherical shaped pig body, the pig body being capable of rolling forward through the interior space of the pipe;

rolling the pig body forward within the gas product flow and through the interior space of the pipe;

capturing temporarily on a surface of the pig body a liquid portion of a volume of liquids residing within an area of the interior space of the pipe as the pig body rolls forward; and redistributing the captured liquid portion within the interior space of the pipe as the pig body continues to roll forward and past the volume of liquids;

wherein the pig body includes at least a first bypass pathway and a second bypass pathway.

2. A method according to claim 1 wherein the first and second bypass pathways allow gas flow to bypass the pig body at a velocity greater than a velocity of the pig body as the pig body rolls forward.

3. A method according to claim 1 wherein the amount of bypass provided by the first bypass pathway is different than the amount of bypass provided by the second bypass pathway.

4. A method according to claim 1 wherein said redistributing step redistributes at least part of the captured liquid portion to an upper quadrant of the interior space of the pipe.

5. A method according to claim 1 wherein the captured liquid portion is less than the volume of liquids available for capture within the area.

6. A method according to claim 1 wherein at least a portion of said rolling step includes rolling along a non-linear path.

7. A method according to claim 1 wherein the first bypass pathway is a through-body pathway and the second bypass pathway is an external bypass pathway.

8. A method according to claim 1 wherein the first bypass pathway is a through-body pathway coaxial to a central axis of the pig body.

9. A method according to claim 1 wherein the first bypass pathway and second bypass pathways are external bypass pathways.

10. A method according to claim 1 wherein the pig body is a hollow body and the first bypass pathway is a through-body pathway provided by a plurality of spaced apart ports arranged about the pig body.

11. A method according to claim 10 wherein the pig body includes a reinforcing layer disposed between an internal and an external wall surface of the hollow body.

12. A method according to claim 10 wherein an internal wall surface of the pig body includes a plurality of ribbed surfaces.

13. A method according to claim 1 wherein at least one of the first and second bypass pathways is formed in part by at least one radially extending paddle-like structure.

14. A method according to claim 1 wherein at least one of the first and second bypass pathways is formed in part by at least two arcuate-shaped surfaces that share a common edge and are arranged substantially orthogonal one another.

15. A method according to claim 14 wherein at least one of two arcuate-shaped surfaces includes a lip located along a circumferential edge of the surface.

16. A method according to claim 14 wherein the first bypass pathway is a port passing through at least one of the two arcuate-shaped surfaces.

17. A method according to claim 1 wherein at least one of the first and second bypass pathways is formed in part by at least two arcuate-shaped oblique-angled surfaces that share a common edge.

18. A method according to claim 17 wherein at least one of the at least two arcuate-shaped oblique-angled surfaces includes a lip located along a circumferential edge of the surface.

19. A method according to claim 1 wherein at least one of the first and second bypass pathways is formed in part by a recessed portion of an external wall surface.

20. A method according to claim 19 wherein the recessed surface is a generally polygonal-shaped recessed surface.

21. A method according to claim 1 wherein at least one of the first and second bypass pathways is formed in part by a textured external wall surface.

* * * * *